US010415598B2

(12) United States Patent
Peckham et al.

(10) Patent No.: US 10,415,598 B2
(45) Date of Patent: Sep. 17, 2019

(54) EZ ADJUST IMPELLER CLEARANCE

(71) Applicant: ITT MANUFACTURING ENTERPRISES LLC., Wilmington, DE (US)

(72) Inventors: Jason D. Peckham, Cato, NY (US); Mark A. Playford, Seneca Falls, NY (US)

(73) Assignee: ITT MANUFACTURING ENTERPRISES LLC, Wilmington, DE (US)

( * ) Notice: Subject to any disclaimer, the term of this patent is extended or adjusted under 35 U.S.C. 154(b) by 254 days.

(21) Appl. No.: 15/477,297

(22) Filed: Apr. 3, 2017

(65) Prior Publication Data

US 2017/0298956 A1 Oct. 19, 2017

Related U.S. Application Data

(60) Provisional application No. 62/318,491, filed on Apr. 5, 2016.

(51) Int. Cl.

| | |
|---|---|
| ***F04D 13/02*** | (2006.01) |
| ***F04D 29/62*** | (2006.01) |
| ***F04D 29/042*** | (2006.01) |
| ***F04D 29/043*** | (2006.01) |

(Continued)

(52) U.S. Cl.

CPC ..... *F04D 29/622* (2013.01); *F04D 29/042* (2013.01); *F04D 29/043* (2013.01);

(Continued)

(58) Field of Classification Search

CPC .... F02D 29/622; F02D 29/042; F02D 29/043; F02D 29/046; F02D 29/22; F02D 29/426; F02D 29/628

(Continued)

(56) References Cited

U.S. PATENT DOCUMENTS 2,926,509 A 3/1960 Green
5,344,291 A * 9/1994 Antkowiak ..... F04D 13/021 415/131

(Continued)

FOREIGN PATENT DOCUMENTS

| | | |
|---|---|---|
| CN | 2842020 Y | 11/2006 |
| CN | 204164003 U | 2/2015 |
| EP | 0105140 A2 | 4/1984 |

OTHER PUBLICATIONS

English language Abstract of CN204164003U.

(Continued)

*Primary Examiner* — Hai H Huynh
*Assistant Examiner* — Gonzalo Laguarda
(74) *Attorney, Agent, or Firm* — Moritt Hock & Hamroff LLP; Bret P. Shapiro

(57) ABSTRACT

A pump features a bearing sleeve couples to a pump shaft, and includes a bearing sleeve surface having bores for receiving fasteners; and an adjusting nut having a central bore with central bore threads to rotationally couple to pump shaft threads, is configured to rotate in relation to the bearing sleeve and move the pump shaft axially to adjust an impeller clearance between a working side of an impeller arranged on the pump shaft and a casing of the pump, and is configured with an adjusting nut surface having openings different in number than the bores, sets of corresponding bores and openings aligning at angular adjustment intervals, e.g. every 9 or 15°, when the adjusting nut is rotated in relation to the bearing sleeve in either direction in order to receive fasteners to couple the adjusting nut to the bearing sleeve when the adjustment of the impeller clearance is completed.

28 Claims, 12 Drawing Sheets

(51) Int. Cl.

| | |
|---|---|
| ***F04D 29/046*** | (2006.01) |
| ***F04D 29/22*** | (2006.01) |
| ***F04D 29/42*** | (2006.01) |
| *F04D 1/00* | (2006.01) |

(52) U.S. Cl.
CPC ..... *F04D 29/046* (2013.01); *F04D 29/22* (2013.01); *F04D 29/426* (2013.01); *F04D 29/628* (2013.01); *F04D 1/00* (2013.01)

(58) Field of Classification Search
USPC ..... 415/131, 132, 133, 173.2, 174.1
See application file for complete search history.

(56) References Cited

U.S. PATENT DOCUMENTS 5,368,439 A * 11/1994 Piazza ..... F04D 29/167 415/131
5,846,049 A * 12/1998 DuPuis ..... F04D 29/042 415/131
6,893,213 B1 5/2005 Quill et al.
2014/0090626 A1* 4/2014 An ..... H02K 5/1732 123/565

OTHER PUBLICATIONS

English language Abstract of CN2842020Y.
Goulds 3171 Grease Lube,corresponding to Figs. 1A, 1B and 1C, printed on Oct. 6, 2017, of Patent Application filed on Apr. 3, 2017. (3 pages).
Flowserve Model ECPJ, corresponding to Fig. 2, printed Oct. 6, 2017, of Patent Application filed on Apr. 3, 2017. (1 page).
Flowserve Model Durco Mark 3, corresponding to Fig. 3A and 3B, printed Oct. 6, 2017, of Patent Application filed Apr. 3, 2017. (2 pages).

* cited by examiner

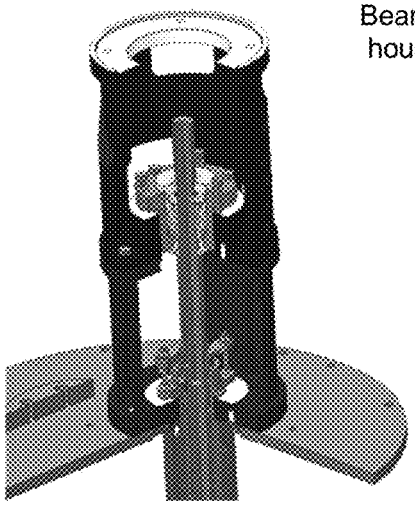
Fig. 1A(1)
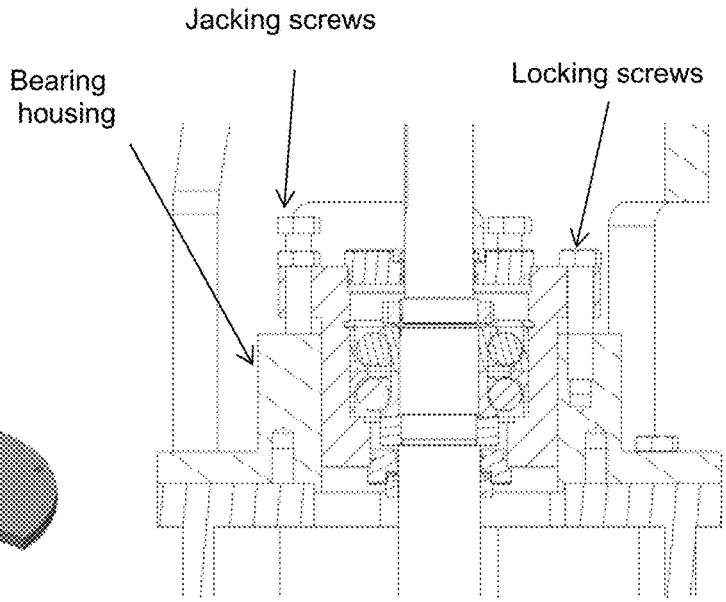
Fig. 1A(2)
Figure 1A: 3171 Grease Lube (Prior art)

Set the impeller clearance - dial indicator method

1. Remove the coupling guard.
2. Set the indicator so that the button contacts either the shaft end or the face of the coupling.

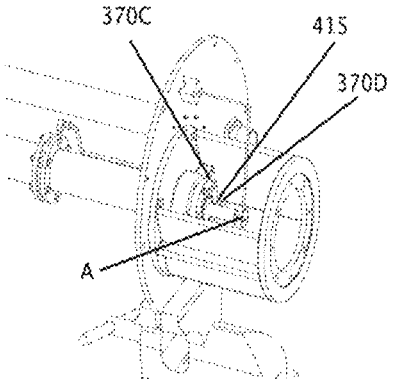

- A—Dial indicator

3. Loosen the jam nuts (415) on the jack bolts (370D) , and then back the bolts out about two turns.
4. Tighten the locking bolts evenly (370C), bringing the bearing housing (134A) towards the frame (228) until the impeller contacts the casing.
5. Turn the shaft to ensure that there is contact between the impeller and the casing.
6. Set the indicator to zero and loosen the locking bolt (370C) about one turn.
7. Thread in the jack bolts (370D) until the jack bolts evenly contact the bearing frame.
8. Tighten the jack bolts evenly about one flat at a time, moving the bearing housing (134A) away from the bearing frame until the indicator shows a clearance of 0.015" (0.381 mm).
9. Tighten the bolts evenly in this order:
   a) Tighten the locking bolts (370C).
   b) Tighten the jack bolts (370D).
   Make sure to keep the indicator reading at the proper setting.
10. Make sure the shaft turns freely.

Figure 1B: Adjustment Procedure for 3171 Grease Lube (Prior art)

Set the impeller clearance - feeler gauge method

1. Lock out the driver power and remove the coupling guard.
2. Remove the coupling, if required.
3. Loosen the jam nuts (415) on the jack bolts (370D), and then back the bolts out about two turns.
4. Evenly tighten the locking bolts (370C) in several turns until the impeller contacts the suction cover.
5. Turn the shaft to ensure that there is contact between the impeller and the suction cover.
6. Loosen the locking bolts (370C) until a 0.015" feeler gauge can be inserted between the underside of the bolt head and the bearing shell (134).

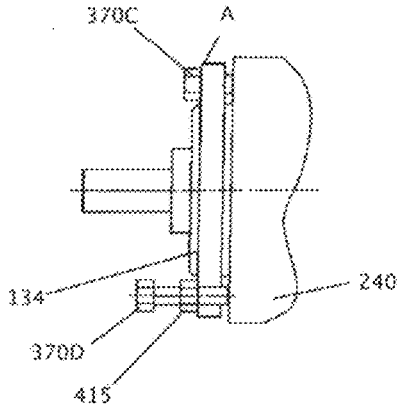

- A—Feeler guage

7. Tighten the jack bolts (370D) evenly until the bearing shell (134) is tight against the locking bolts. Make sure all bolts are tight.
8. Evenly tighten the jam nuts (415).
9. Make sure the shaft turns freely.
10. Replace the coupling.
11. Replace the coupling guard.

Figure 1C: Adjustment Procedure for 3171 Grease Lube (Prior art)

Figure 2: Flowserve Model ECPJ (Prior art)

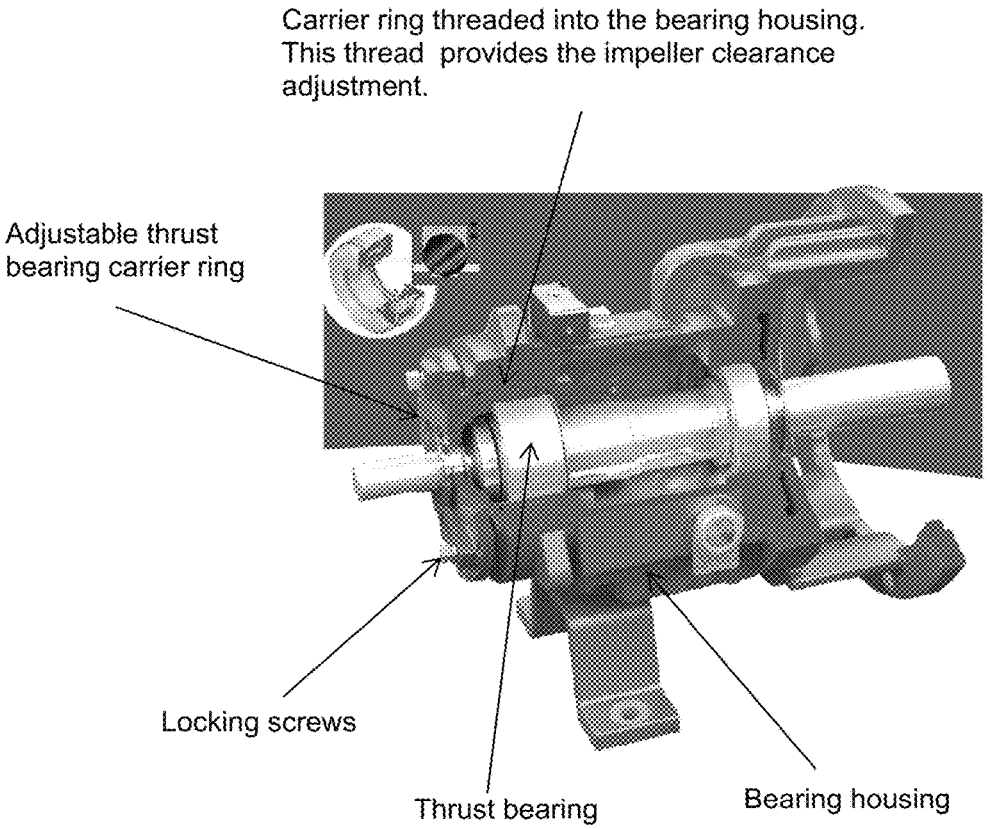
Figure 3A: Flowserve Model Durco Mark 3 (Prior art)

Fig. 3B(1)

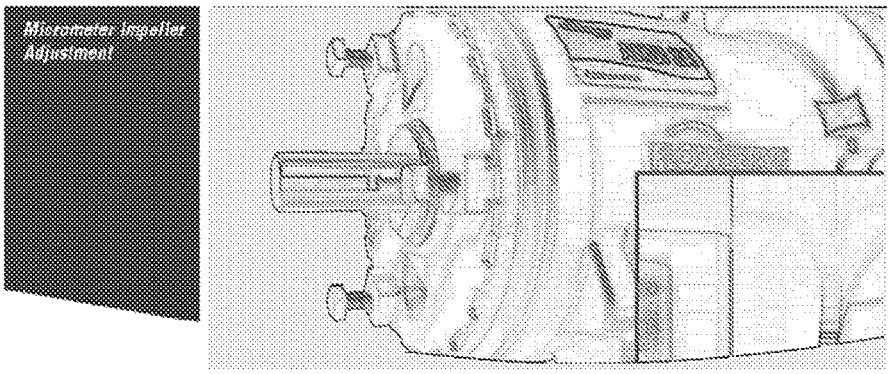

*Unique External Micrometer Reduces Maintenance Time and Costs*

Durco's innovative external micrometer impeller adjustment mechanism is simple to use and reduces maintenance time and costs. Most importantly, though, it is precisely accurate.

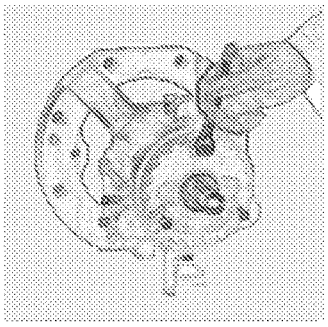

Step 1: Loosen the setscrews. Using a wrench, rotate the bearing carrier counterclockwise until the impeller lightly touches the rear cover plate.

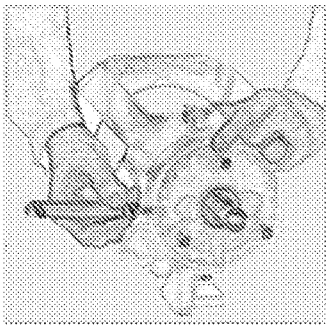

Step 2: Select the impeller setting. Each notch on the carrier ring represents exactly 0.10 mm (0.004 in) of clearance. For an impeller setting of 0.5 mm (0.020 in), count five notches counterclockwise.

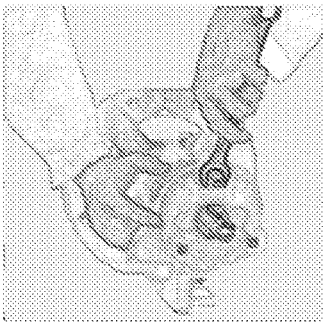

Step 3: Move the carrier clockwise the selected number of notches. Tighten the setscrews and check the impeller clearance with the feeler gauge.

Fig. 3B(2) Fig. 3B(3) Fig. 3B(4)

Figure 3B: Adjustment procedure for Flowserve Model Durco Mark 3 (Prior art)

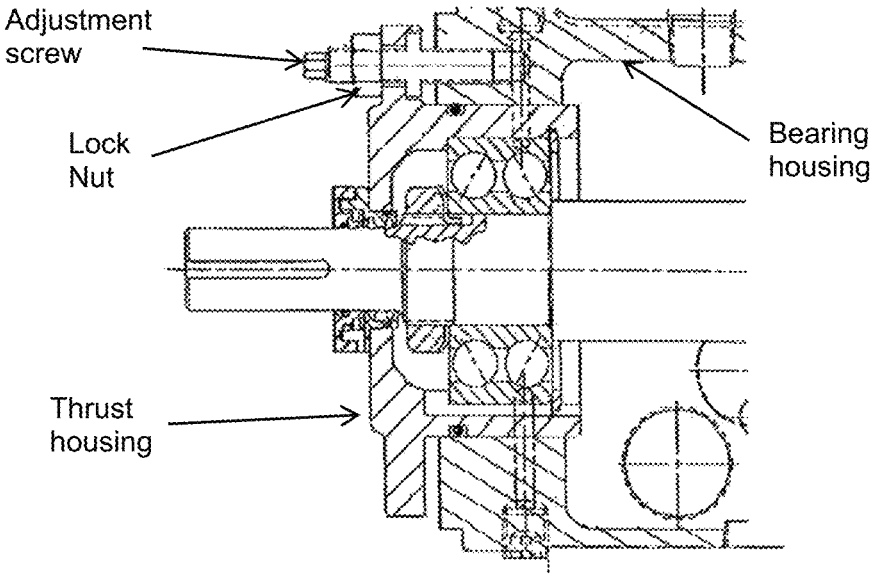
Figure 4: Patent No. US 6,893,213 B1 (Prior art)

Fig. 5B
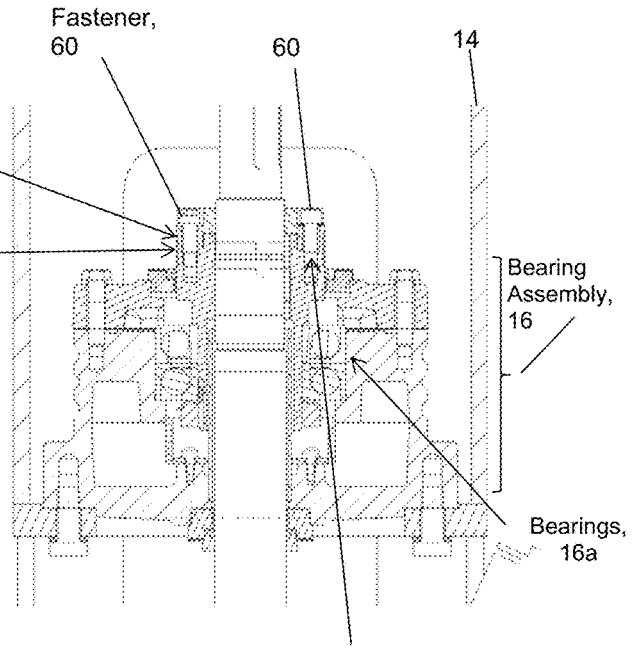
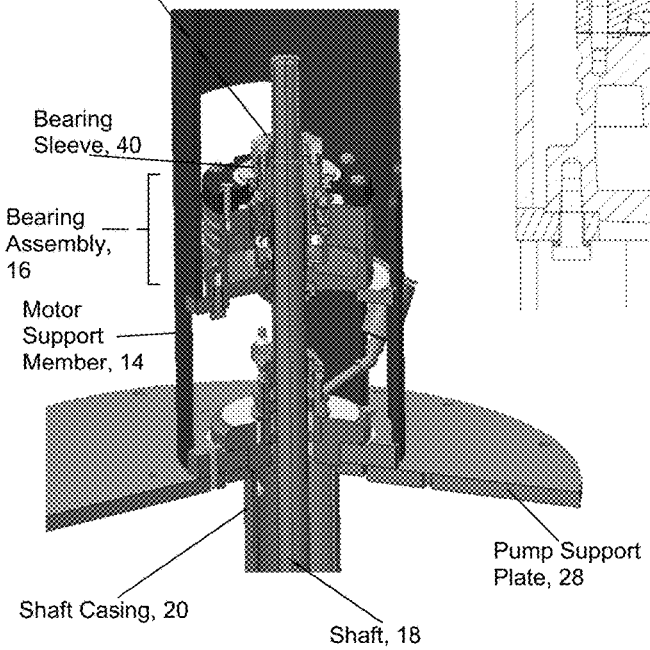
Fig. 5A

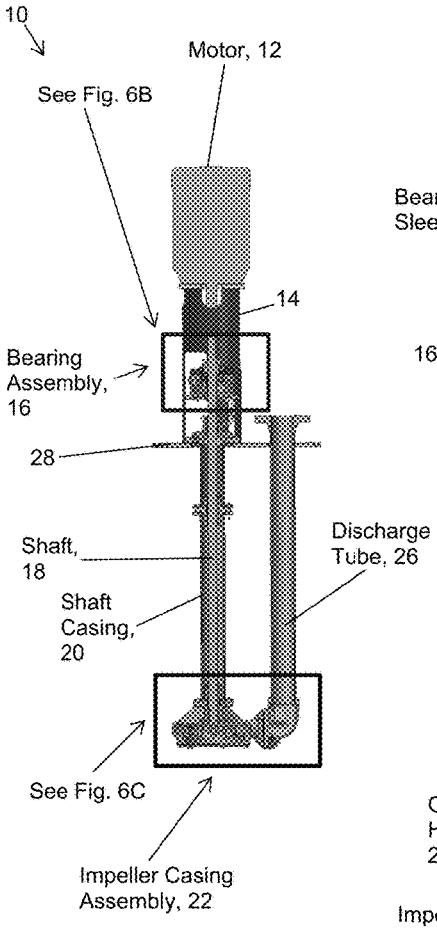
Fig. 6A
Fig. 6B
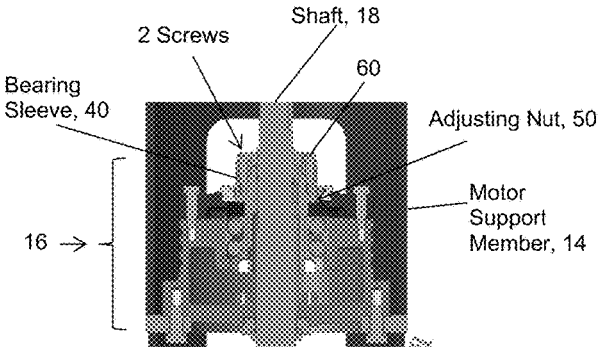
Removing the two screws and turning the adjusting nut, the impeller clearance can be adjusted
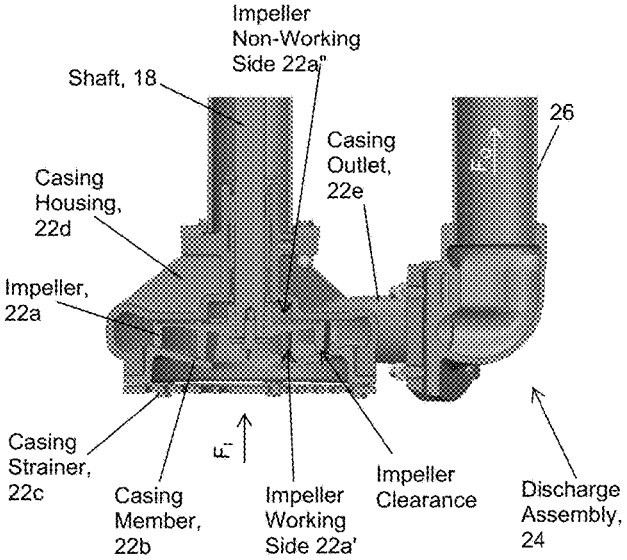
Fig. 6C
Figure 6

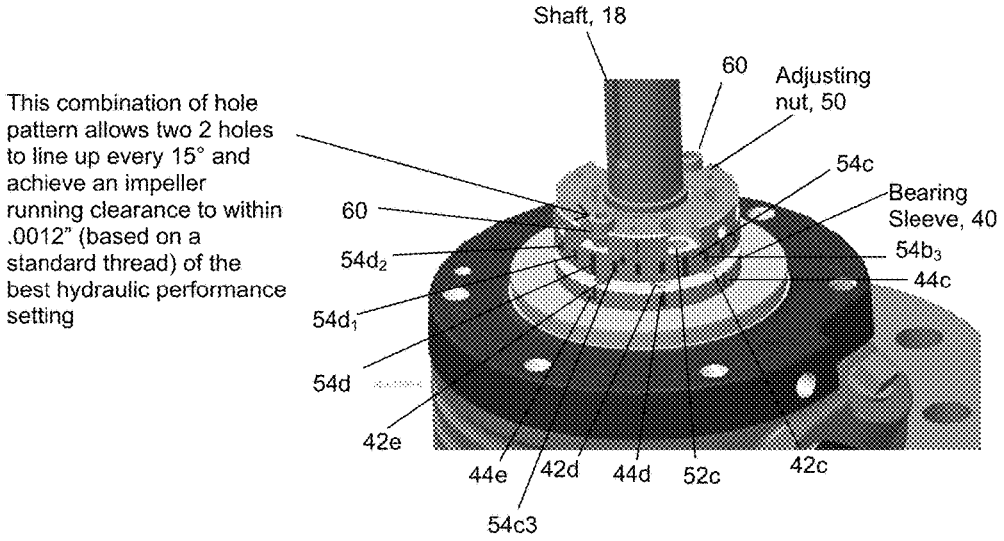
Figure 7: Adjusting Nut & Bearing Sleeve assembled
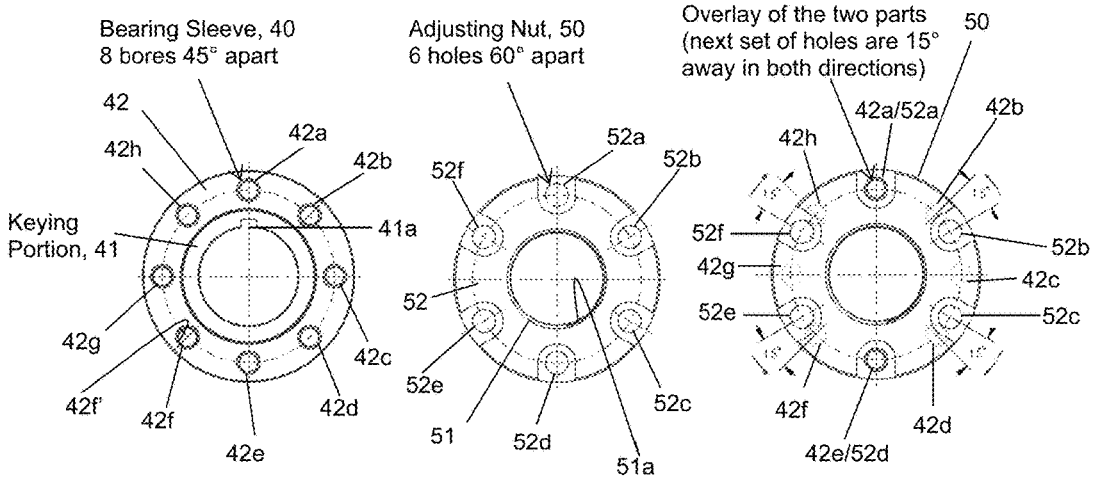
Fig. 8A Fig. 8B Fig. 8C
Figure 8: Adjusting Nut & Bearing Sleeve Hole layout

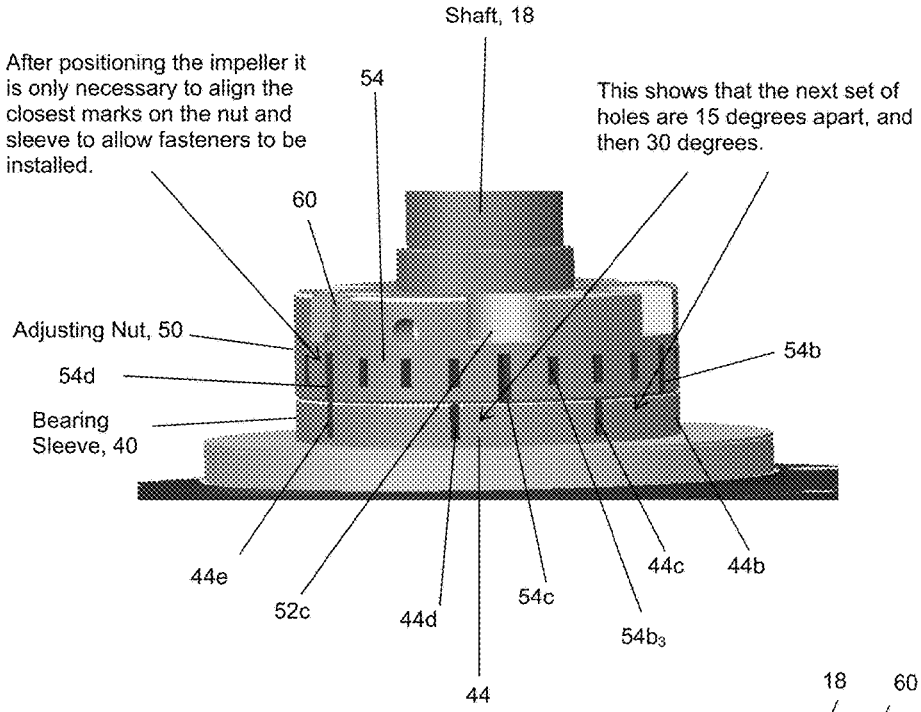
Figure 9: Scale Markings on the Diameter
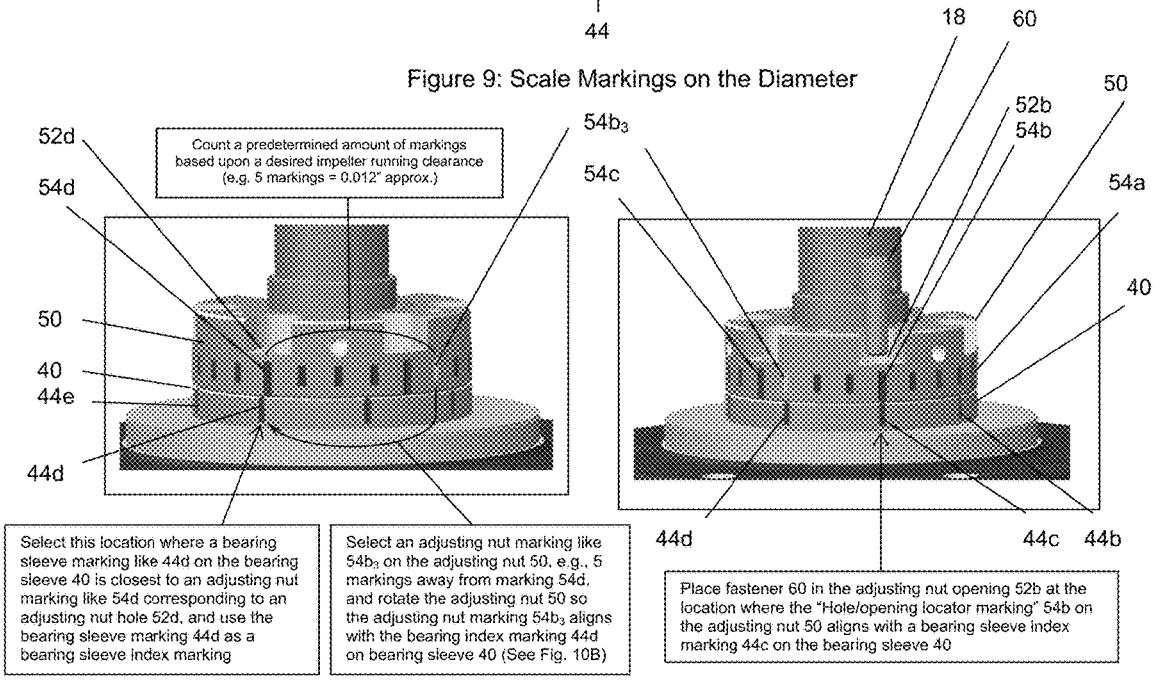
Fig. 10A (Zero Point)
Fig. 10B (Impeller Running clearance set)
Figure 10

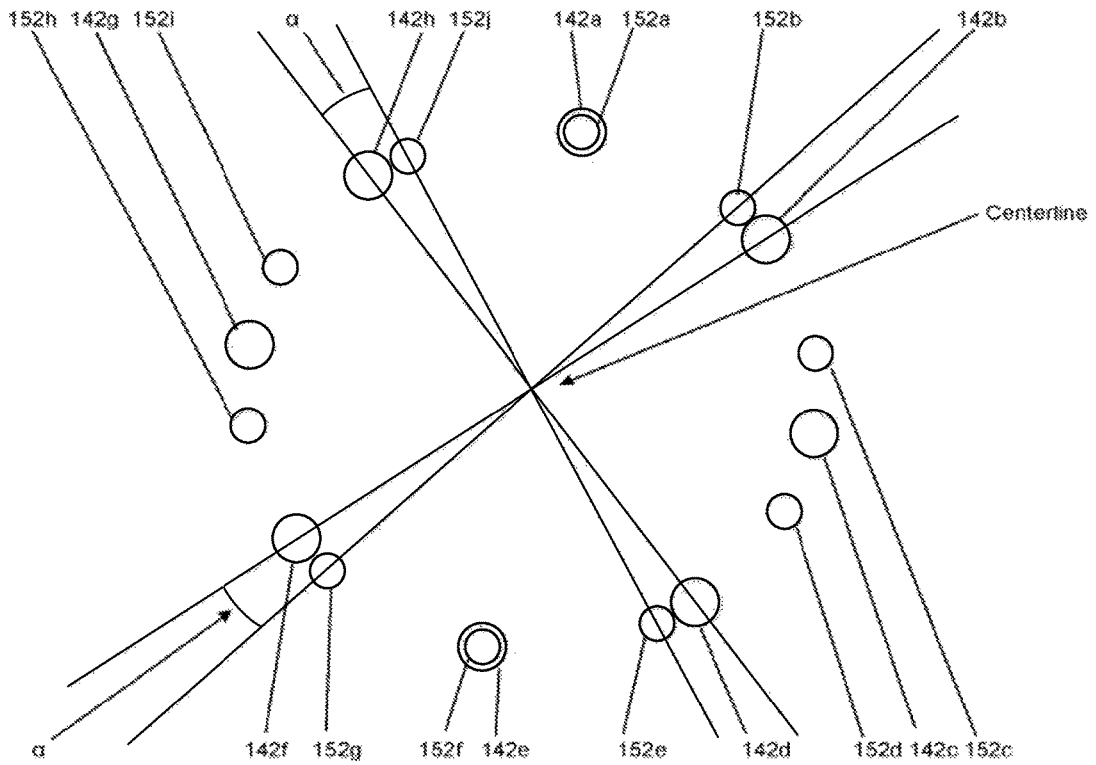
Figure 11: The 10-8 Bore/Hole Combination

EZ ADJUST IMPELLER CLEARANCE

CROSS REFERENCE TO RELATED APPLICATION

This application claims benefit to U.S. provisional application No. 62/318,491, filed 5 Apr. 2016, which is hereby incorporated by reference in its entirety.

BACKGROUND OF THE INVENTION

1. Field of the Invention

This application relates to a technique for adjusting an impeller clearance in relation to a casing of a pump.

2. Brief Description of Related Art

In centrifugal pumps the impeller position inside the casing must be accurately set. The hydraulic performance of open vane impeller pumps are especially sensitive to this position being set correctly. The impeller clearance on an open vane impeller is the gap between the vane side of the impeller and the casing. Adjusting the impeller clearance by 0.002 inch to 0.003 inch can change the hydraulic performance of a pump from being within tolerance to being out of tolerance.

Sump pumps, also known as vs4 pumps, are a type of centrifugal pump where the shaft is mounted vertically. The pump itself is below the surface of the liquid being pumped and the motor or driver is above the top of the sump pit. The shaft extends from the impeller up through a plate located at the top of the sump pit (support plate) where it is vertically fixed using thrust bearings. The thrust bearings are mounted in a bearing housing and fixed to the support plate in some fashion. The casing is also fixed to the support plate through a number of flanged pipes bolted together. Due to tolerance stack-up of all the above mentioned components adjustment of the impeller to the casing is necessary to give the desired impeller clearance.

Setting the impeller clearance is typically achieved by some form of adjustment at the thrust bearing end of the shaft. The impeller is hard mounted to the shaft; therefore any adjustment made to the shaft directly influences the impeller clearance.

FIG. 1 (Goulds 3171 Grease Lube)

FIG. 1A shows Goulds' 3171 Grease Lube, which is known in the art. As shown in FIG. 1A, the thrust bearings directly mounts to the shaft, and the bearing housing directly mounts to the thrust bearings. Therefore, the bearing housing's vertical location can be assumed to move directly with the shaft. The bearing housing sits on a surface directly mounted to the support plate. Jacking screws threaded in the bearing housing lift the bearing housing off the face of the support plate. This allows precise adjustment of the impeller clearance. With a precise impeller clearance setting a repeatable pump hydraulic performance can be achieved.

With this design the impeller clearance is typically set using a feeler gauge method as set forth in FIG. 1C, but can also be set using the dial indicator method, as set forth in FIG. 1B. Both procedures require a very detailed process to be followed which allows for human error, and both require some kind of special measurement tool to be used. Additionally, both procedures are also time consuming for setting the impeller clearance.

FIG. 2 (Flowserve Model ECPJ)

FIG. 2 shows Flowserve Model ECPJ, which is known in the art, and which is based upon a technique that directly mounts the thrust bearing housing to the support plate. The thrust bearings are mounted in the bearing housing and on a slide fit, key driven sleeve. This sleeve is keyed to the shaft. The adjustment nut sits on top of the sleeve, and has adjustment nut threads that are threaded to the pump shaft threads, as shown in FIG. 2A. Rotating the adjustment nut raises and lowers the shaft with respect to the support plate, and raises and lowers the impeller with respect to the casing of the pump.

During an impeller clearance adjustment, the shaft and impeller are lowered until the face of the impeller rests against a wall of the casing. This condition will be known because the adjustment nut starts to lift off the bearing sleeve. The adjustment nut is then tightened, lifting the shaft and impeller to a desired impeller clearance. Once the impeller clearance is set, the three (3) screws are used to lock the adjustment nut to the bearing sleeve.

This adjustment design allows for a finite impeller clearance setting. The adjustment nut must be turned in 120 degree increments. Based on the adjustment nut thread being used, this increment may not allow for desired impeller clearance to be set. This variation in the impeller clearance would result in a wide variation in pump hydraulic performance.

FIG. 3 (Flowserve Model Durco Mark 3)

FIG. 3 shows Flowserve Model Durco Mark 3, which is known in the art and is based upon a technique that was originally intended for use on horizontal pumps, but can be translated to vertical pumps. The thrust bearing is directly mounted to the shaft. There is an adjustable thrust bearing carrier ring that the thrust bearing race is mount into. This carrier ring is threaded on the outside diameter into the bearing housing, which allows the carrier ring to be turned about the axis of the shaft to adjust the impeller clearance. Cast in notches on the outside of the carrier ring represent finite impeller clearance increments (0.004 inches). FIGS. 3B(1) through 3B(4) show an adjustment procedure. Once the impeller clearance is set three (3) lock screw are tightened which lock the rotation of the carrier ring. These lock screws do not thread into anything, they just push against the bearing housing. This means a precise adjustment can be made, but does allow for human interpretation of the setting. The adjustment thread is a large diameter, fine pitch thread. This allows the thrust bearing to be located inside the thread while maintaining a fine adjustment of the impeller clearance. This design requirement drives up the cost of the bearing frame and carrier ring arrangement.

FIG. 4

FIG. 4 shows a technique for adjusting an impeller clearance in a pump that is disclosed in U.S. Pat. No. 6,893,213 B1 and known in the art, The technique was originally intended for use on horizontal pumps, but can be translated to vertical pumps. The thrust bearing is directly mounted to the shaft. There is an adjustable thrust housing that the thrust bearing race is mount into. A number of shouldered adjustment screws are threaded into the bearing housing. The thrust housing is mounted on the shoulders of the adjustments screws. Above the shoulder of the adjustment screw protrudes another threaded section. This section goes all the way through a flange on the thrust housing. A lock nut is used to clamp the thrust housing between the flange of the adjustment screw and the lock nut. Finally, a short hex protrudes from the top of the top threaded section of the adjustment screw. This hex allows the adjustment screw to be turned into or out of the bearing housing. As in prior art shown in FIG. 1, special measuring tools and a detailed process are required to correctly set the impeller clearance using this design.

SUMMARY OF THE INVENTION

The present invention provides a new and unique way to adjust an impeller clearance in a pump, e.g., including a vertical sump pump.

By way of example, instead of using three (3) holes in the adjustment nut and three (3) holes in the bearing sleeve like that used in the prior art pump configuration, e.g., shown in FIG. 2, the present invention uses six (6) holes in the adjustment nut and eight (8) holes in the bearing sleeve. This difference allows for two (2) holes in the adjustment nut and bearing sleeve to line up in 15 degree increments instead of 120 degree increments like that in the prior art, which gives an 8 times improvement in the ability to fine tune the impeller clearance.

Consistent with that set forth herein, and according to the present invention, turning or rotating the adjustment nut either way 15 degree would allow a different set of holes to line up. Moreover, markings may be used on the outside diameter of the adjustment nut and the bearing sleeve that align with the center of the holes, which allows an assembler to line up the holes and start threading the locking screws. Two (2) locking screws/fasteners may be used to lock the rotation of the adjustment nut to the bearing sleeve.

Certain advantage over the aforementioned prior art pump configuration shown in FIGS. 1 and FIG. 4 are afforded in the procedure for setting the impeller clearance according to the present invention. Based on the adjustment nut thread, a finite value of impeller clearance adjustment is known. One can precisely set the impeller clearance without using any additional tools or measuring devices. There is also less margin for error setting the impeller clearance using this design than the prior art pump configuration shown in FIGS. 1 and 4. Also, setting the impeller clearance with the present invention is faster than setting it in the prior art pump configuration shown in FIGS. 1 and 4.

As mentioned above, the prior art pump configuration shown in FIG. 3 uses lock screws that do not thread into anything, they just push against the bearing housing, which allows for, or introduces into the adjustment process, human interpretation of the impeller clearance setting. In comparison, the present invention uses machined holes to set the adjustment nut, therefore making it a much more repeatable design. Additionally, in the prior art the adjustment thread is a large diameter, fine pitch thread, which drives up cost of the bearing frame and carrier ring. In further comparison, the present invention uses a standard thread pitch for the shaft size being used. Therefore, it is a lower cost machining operation. For these reasons, the present invention is an improvement over the prior art pump configuration shown in FIG. 3, and provides an important contribution to the state of the art.

Summary of Basic Functionality

According to some embodiments, the present invention may include, or take the form of, a pump featuring a bearing sleeve in combination with an adjusting nut.

The bearing sleeve may be configured to couple to a pump shaft, and also configured with a bearing sleeve surface having bores for receiving fasteners.

The adjusting nut (aka an "adjustment nut") may be configured with a central bore having central bore threads to rotationally couple to pump shaft threads of the pump shaft. The adjusting nut may also be configured to rotate in relation to the bearing sleeve and move (i.e. raise or lower) the pump shaft axially to adjust an impeller clearance between a working side of an impeller arranged on the pump shaft and a casing of the pump. The adjusting nut may also be configured with an adjusting nut surface having openings that are different in number than the bores, where sets of corresponding bores and openings are configured to align at angular adjustment intervals, e.g., about every 9° or 15°, when the adjusting nut is rotated in relation to the bearing sleeve in either rotational direction in order to receive fasteners to couple the adjusting nut to the bearing sleeve when the adjustment of the impeller clearance is completed.

The present invention may also include one or more of the following features:

The bores of the bearing sleeve may include eight (8) bores, and the openings of the adjusting nut may include six (6) openings. Alternatively, embodiments are also envisioned, and the scope of the invention is intended to include, e.g., using a bearing sleeve having six (6) bores, and an adjusting nut having eight (8) openings within the spirit of the present invention.

The bores of the bearing sleeve may be equally spaced about the bearing sleeve surface about 45° apart, and the openings of the adjusting nut may be equally spaced about 60° apart about the adjusting nut surface.

One set of the corresponding bores and openings may be diametrically opposed from another set of the corresponding bores and openings on opposite sides of the bearing sleeve surface and adjusting nut surface.

The bearing sleeve may include a circumferential bearing sleeve surface having bearing sleeve markings corresponding to the bores; and the adjusting nut may include a circumferential adjusting nut surface having adjusting nut markings corresponding to the openings, so that after positioning the working side of the impeller in relation to the casing, closest markings on the circumferential bearing sleeve surface and the circumferential adjusting nut surface may be aligned to allow each fastener to be installed in a respective set of the corresponding bores and openings.

The circumferential adjusting nut surface may also include one or more additional adjusting nut markings between each pair of adjusting nut markings corresponding to the openings. By way of example, the one or more additional adjusting nut markings may include three additional adjusting nut markings between each pair of adjusting nut markings corresponding to the openings spaced equidistantly so as to be at about 15° intervals. The one or more additional adjusting nut marking may have a different length than the adjusting nut marks corresponding to the openings, e.g., including being slightly shorter in length than the adjusting nut marks corresponding to the openings.

Embodiment may include a bearing assembly having in combination a bearing housing, bearings arranged therein, the bearing sleeve and the adjusting nut.

Embodiment may include combinations where the pump includes the casing, or includes the pump shaft having the impeller hard mounted on one end.

The bores may be configured or formed in the bearing sleeve, and the openings may be configured or formed to pass completely through the adjusting nut, so that each fastener passes completely through the adjusting nut and fastener threads engage a respective thread of a respective bore.

Moreover, and by way of further example, the threads per inch (TPI) on the pump shaft surface may be configured using a Unified Thread Standard (UTS), such that the impeller clearance setting accuracy is dependent on the set value of the TPI on the pump shaft.

Further, the number of openings in the adjusting nut and the bores in the shaft sleeve will determine the degrees of intervals, such that the impeller clearance setting accuracy is dependent.

For example, an adjusting nut affixed with 8 equally spaced openings and a bearing sleeve having 6 equally spaced bores will achieve about 15° adjustment intervals. With a pump shaft surface configured with an 18 TPI, one full 360° rotation of the adjusting nut would equal about 0.0556" of shaft travel (1"/18 TPI) and at about 15° of rotation would equal about 0.0023" of shaft travel ((1"/18 TPI)/(360/15)). The impeller setting accuracy would have tolerances of about 0.0012" (i.e., 0.0023" of travel/2).

By way of further example, and consistent with that set forth below, if the hole/bore combination is changed to a 10-8 hole/bore combination, achieving about 9° adjustment intervals using a shaft surface having 20 TPI, then the result would be about 0.00125" of shaft travel. For this implementation, the impeller setting accuracy would have tolerances of about 0.00063". Alternatively, when using 9° intervals and a pump shaft with 18 TPI results in about 0.0014" of shaft travel.

By way of example, the pump may be, or take the form of, a horizontal pump or a vertical pump, e.g., including where the vertical pump is a vertical sump pump.

Further, according to some embodiments, the present invention may take the form of a bearing assembly, e.g., featuring a combination of a bearing sleeve and an adjusting nut. The bearing sleeve may be configured to couple to a pump shaft, and also configured with a bearing sleeve surface having bores for receiving fasteners, the bores being arranged uniformly about the pump shaft at a first predetermined angle. The adjusting nut may be configured with a central bore having central bore threads to rotationally couple to pump shaft threads of the pump shaft, configured to rotate in relation to the bearing sleeve and move the pump shaft axially to adjust an impeller clearance between a working side of an impeller arranged on the pump shaft and a casing of rotating equipment, and configured with an adjusting nut surface having openings that are different in number than the bores, the openings being arranged uniformly about the pump shaft at a second predetermined angle that is different from the first predetermined angle. In this combination, sets of corresponding bores and openings configured to align at predetermined angular intervals defined by a differential relationship between the first predetermined angle and the second predetermined angle, e.g., including at the predetermined angular intervals of about every 9° or 15°, when the adjusting nut is rotated in relation to the bearing sleeve in either direction in order to receive fasteners to couple the adjusting nut to the bearing sleeve when the adjustment of the impeller clearance is completed. The rotating equipment may include, or take the form of, a pump, as well as other types or kinds of rotating equipment either now known or later developed in the future. The bearing assembly may also include one or more of the other features set forth herein.

Furthermore, according to some embodiments, the present invention may take the form of an impeller/casing adjustment combination for adjusting an impeller in relation to a casing of a pump, e.g., featuring a combination of a pump shaft, a bearing sleeve and an adjusting nut. The pump shaft may include a pump shaft surface with pump shaft threads configured on one end, and having an impeller configured on another end. The bearing sleeve may be configured to couple to the pump shaft, and also configured with a bearing sleeve surface having bores for receiving fasteners, the bores being arranged uniformly about the pump shaft at a first predetermined angle. The adjusting nut may be configured with a central bore having central bore threads to rotationally couple to the pump shaft threads of the pump shaft, configured to rotate in relation to the bearing sleeve and move the pump shaft axially to adjust an impeller clearance between a working side of the impeller and a casing of a pump, and configured with an adjusting nut surface having openings that are different in number than the bores, the openings being arranged uniformly about the pump shaft at a second predetermined angle that is different from the first predetermined angle. In this combination, sets of corresponding bores and openings configured to align at predetermined angular intervals defined by a differential relationship between the first predetermined angle and the second predetermined angle, e.g., including at the predetermined angular intervals of about every 9° or 15°, when the adjusting nut is rotated in relation to the bearing sleeve in either direction in order to receive fasteners to couple the adjusting nut to the bearing sleeve when the adjustment of the impeller clearance is completed. The impeller/casing adjustment combination may also include one or more of the other features set forth herein.

Furthermore, according to some embodiments, the present invention may take the form of a pump featuring a new and unique combination of a bearing sleeve and an adjusting nut. The bearing sleeve may be configured to couple to a pump shaft, and also configured with a bearing sleeve surface having bores for receiving fasteners, the bores being arranged uniformly about the pump shaft at a first predetermined angle. The adjusting nut may be configured with a central bore having central bore threads to rotationally couple to pump shaft threads of the pump shaft, configured to rotate in relation to the bearing sleeve and move the pump shaft axially to adjust an impeller clearance between a working side of an impeller arranged on the pump shaft and a casing of rotating equipment, and configured with an adjusting nut surface having openings that are different in number than the bores, the openings being arranged uniformly about the pump shaft at a second predetermined angle that is different from the first predetermined angle. In this combination, sets of corresponding bores and openings may be configured to align at predetermined angular intervals defined by a differential relationship between the first predetermined angle and the second predetermined angle when the adjusting nut is rotated in relation to the bearing sleeve in either direction in order to receive fasteners to couple the adjusting nut to the bearing sleeve when the adjustment of the impeller clearance is completed.

By way of example, either the bores may include eight (8) bores uniformly arranged about the pump shaft at about 45°, and the openings may include six (6) openings uniformly arranged about the pump shaft at about 60°, or the bores may include six (6) bores uniformly arranged about the pump shaft at about 60°, and the openings may include eight (8) openings uniformly arranged about the pump shaft at about 45°; and the predetermined angular intervals are about 15°.

By way of example, either the bores may include eight (8) bores uniformly arranged about the pump shaft at about 45°, and the openings may include ten (10) openings uniformly arranged about the pump shaft at about 36°, or the bores may include ten (10) bores uniformly arranged about the pump shaft at about 36°, and the openings may include eight (8) openings uniformly arranged about the pump shaft at about 45°; and the predetermined angular intervals are about 9°.

The pump shaft may also include a pump shaft surface having a predetermined number of threads per inch (TPI) that determines the travel of the adjusting nut when the adjusting nut is rotated in relation to the bearing sleeve in either direction in order to receive fasteners to couple the adjusting nut to the bearing sleeve during the adjustment of the impeller clearance; and the predetermined angular intervals are configured to determine the increments for setting the impeller clearance when the adjustment of the impeller clearance is completed.

BRIEF DESCRIPTION OF THE DRAWING

The drawing includes the following Figures:

FIG. 1 includes FIGS. 1A(1), 1A(2), 1B and 1C, where FIG. 1A(1) is a ¾ cross-sectional view of a vertical sump pump that is known in the art as an ITT Goulds3171 Vertical Sump and Process Pump; where FIG. 1A(2) is a ½ vertical cross-sectional schematic view of the vertical sump pump shown in FIG. 1A(1); where FIG. 1B shows steps for an adjustment procedure of the vertical sump pump shown in FIG. 1A(1) using a dial indicator method; and where FIG. 1C shows steps for an adjustment procedure of the vertical sump pump shown in FIG. 1A(1) using a feeler gauge method.

FIG. 2 includes FIGS. 2A and 2B, where

FIG. 3A is a ¾ longitudinal cross-sectional view of a pump that is known in the art as a Flowserve Model Durco Mark 3.

FIG. 3B includes FIGS. 3B(1), 3B(2), 3B(3) and 3B(4), where FIG. 3B(1) is a perspective side sectional view of the pump that is known in the art as a Flowserve Model Durco Mark 3 and shown in FIG. 3A; where FIG. 3B(2) shows step 1 for an adjustment procedure of the pump shown in FIG. 3B(1); where FIG. 3B(3) shows step 2 for the adjustment procedure of the pump shown in FIG. 3B(1); and where FIG. 3B(4) shows step 3 for the adjustment procedure of the pump shown in FIG. 3B(1).

FIG. 4 is a ½ longitudinal cross-sectional schematic view of a pump disclosed in U.S. Pat. No. 6,893,213 B1 that is known in the art.

FIG. 5 includes FIGS. 5A and 5B, where FIG. 5A is a ¾ cross-sectional view of a vertical sump pump according to the present invention; and where FIG. 5B is a ½ vertical cross-sectional schematic view of the vertical sump pump shown in FIG. 5A, according to some embodiments of the present invention.

FIG. 6 includes FIGS. 6A, 6B and 6C, where FIG. 6A is a ½ vertical cross-sectional view of a vertical sump pump according to the present invention; where FIG. 6B is a ½ vertical cross-sectional schematic view of a bearing assembly that forms part of the vertical sump pump shown in FIG. 6A; and where FIG. 6C is a ½ vertical cross-sectional schematic view of an impeller casing assembly that forms part of the vertical sump pump shown in FIG. 6A, all according to some embodiments of the present invention.

FIG. 7 is a top perspective view of part of the bearing assembly shown in FIG. 6B, according to some embodiments of the present invention.

FIG. 8 includes FIGS. 8A, 8B and 8C, where FIG. 8A is a top down view of a bearing sleeve that forms part of the bearing assembly shown in FIG. 7; where FIG. 8B is a top down view of an adjusting nut that forms part of the bearing assembly shown in FIG. 7; and where FIG. 8C is a diagram of an overlay the adjusting nut shown in FIG. 8B and the bearing sleeve (in phantom).

FIG. 9 is a side view of part of the bearing assembly shown in FIG. 7 showing scale marking on the circumferential surface of the adjusting nut and the bearing sleeve, according to some embodiments of the present invention.

FIG. 10 includes FIGS. 10A and 10B, where FIG. 10A shows a bearing sleeve arranged in relation to an adjusting nut where the impeller and casing are in contact with one another before an impeller running clearance is set; and where FIG. 10B shows the bearing sleeve arranged in relation to adjusting nut after the alignment of a bearing sleeve index marking and a selected adjusting nut marking are aligned and the impeller running clearance between the impeller and the casing is set at about 0.012".

FIG. 11 is a diagram of an alternative 10-8 hole bore combination, where the adjusting nut may be configured with 10 holes, and the bearing sleeve may be configured with 8 bores, e.g., achieving about a 9° adjustment intervals when using a shaft surface having 20 TPI, according to some embodiments of the present invention.

DETAILED DESCRIPTION OF THE INVENTION

Figure 2A:
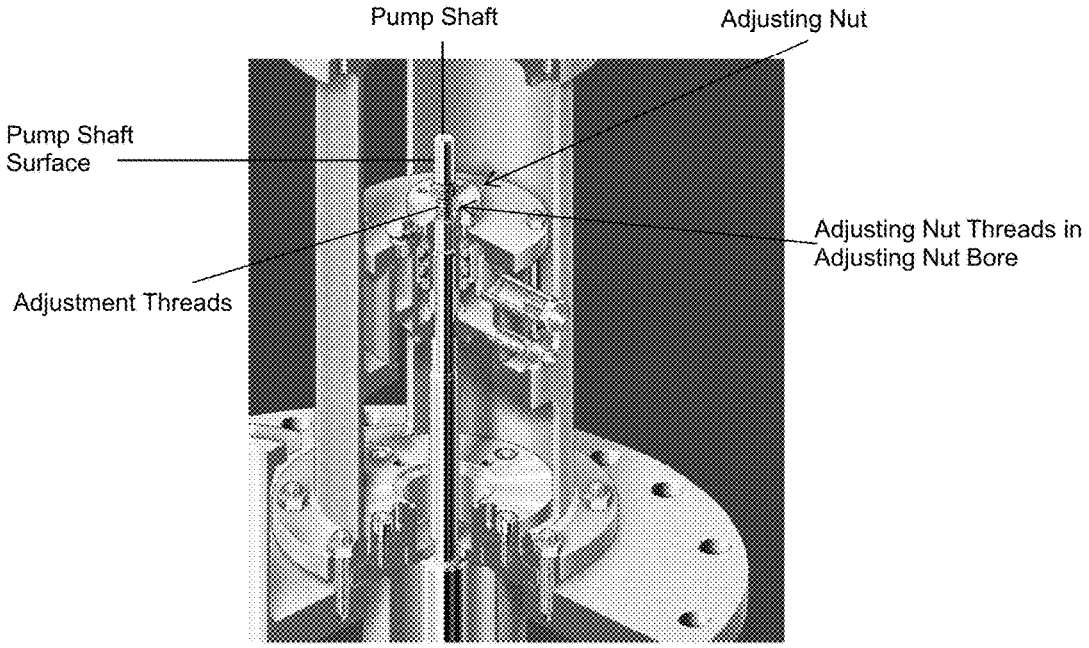
FIG. 2A is a ¾ cross-sectional view of a pump that is known in the art as Flowserve Model ECPJ; and where

FIGS. 5-9 show the present invention, which is described in further detail below:

By way of example, FIGS. 5-6 shows a pump generally indicated as 10 (FIG. 6A), which takes the form of a vertical sump pump as shown, although the scope of the invention is not intended to be limited to any particular type or kind of pump either now known or later developed in the future, e.g., including horizontal pumps.

The pump 10 includes a motor 12, a motor support member 14, a bearing assembly 16, a shaft 18, a shaft casing 20, an impeller/casing assembly 22, a discharge assembly 24, a discharge 26 and a pump support plate 28. The impeller/casing assembly 22 includes an impeller 22*a*, a casing member or surface 22*b*, a casing bottom plate 22*c*, a casing housing 22*d* and a casing outlet 22*e*. The impeller 22*a* has a working side 22*a*' and a non-working side 22*a*", as shown in FIG. 6C.

In operation, the motor 12 turns the shaft 18, which drives the impeller 22*a* inside the casing housing 22*d*, draws fluid $F_i$ through the casing bottom plate 22*c* into the casing housing 22*d*, and discharges fluid Fo from the casing housing 22*d* via the casing outlet 22*e* to discharge assembly 24 and via the discharge tubing 26 to the surface. The shaft 18 couples the motor 12 and the impeller 22*a*, and is arranged in the bearing assembly 16 (see FIG. 5A). The bearing assembly 16 includes bearings 16*a* and is rotationally coupled to the adjusting nut 50 and configured to provide rotational support for the shaft 18 when rotated. The bearing assembly 16 includes many other parts/components that have similarity in design to the above mentioned prior art shown in FIG. 2, e.g., including the manner in which the bearing assembly 16 is configured and coupled in relation to the motor support member 14; and the manner in which the bearing assembly 16 is configured and coupled to the pump shaft 18 in allow the impeller 22*a* to be raised and lowered with respect to the casing member 22*b*.

Figure 2B:
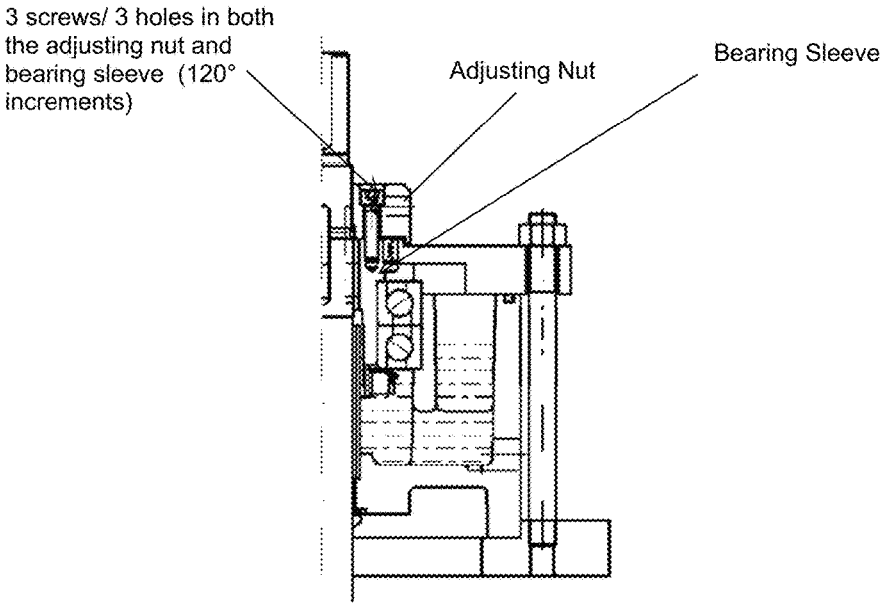
FIG. 2B is a partial right side ½ cross-sectional schematic view of the pump shown in FIG. 2A.

However, in contrast to that disclosed in relation to FIG. 2, the bearing assembly 16 according to the present invention includes a new and unique combination of a bearing sleeve 40 and an adjusting nut 50, which allows a new and very effective way to more precisely adjust the clearance between the impeller 22*a* and the casing member 22*b* (See FIG. 6C). As described in relation to FIG. 6B, by removing the two screws/fasteners 60 and turning the adjusting nut 50, the impeller clearance can be adjusted, e.g., consistent with that set forth herein.

For example, the bearing sleeve 40 may be configured to couple to the pump shaft 18. The coupling may take the form of a key-based coupling arrangement, where the bearing sleeve 40 has a keying portion 41 with a key 41*a* (see FIG. 8A) that couples to a corresponding key on the surface of the shaft 18 so that, when the shaft 18 rotates, the bearing sleeve 40 also rotates in relation to the bearings 16*a* of the bearing assembly 16. Key-based coupling techniques, e.g., between a shaft like element 18 and a bearing sleeve like element 40 are known in the art, and the scope of the invention is not intended to be limited to any particular type or kind thereof either now known or later developed in the future. As shown in FIG. 8A, the bearing sleeve 40 may also be configured with a bearing sleeve surface 42 having bores 42*a*, 42*b*, 42*c*, 42*d*, 42*e*, 42*f*, 42*g*, 42*h* (see FIG. 8A) with bore threads for engaging fastener threads of fasteners like elements 60 (see FIGS. 5B, 7 and 9). (In order to reduce clutter in the drawing, including FIG. 8A, one bore thread is labelled as 42*f*.)

The adjusting nut 50 may be configured with a central bore 51 having central bore threads 51*a* to rotationally couple to pump shaft threads of a pump shaft surface of the shaft 18. By way of example, the reader is referred to FIG. 2A, which shows the pump shaft threads. The adjusting nut 50 may also be configured to rotate in relation to the bearing sleeve 50 and move (raise or lower) the pump shaft 18 axially to adjust the impeller clearance between the working side 22*a*' of the impeller 22*a* arranged on the shaft 18 and the casing member 22*b* of the pump 10. As shown in FIG. 8B, the adjusting nut 50 may also be configured with an adjusting nut surface 52 having openings 52*a*, 52*b*, 52*c*, 52*d*, 52*e*, 52*f* that are different in number than the bores 42*a*, 42*b*, 42*c*, 42*d*, 42*e*, 42*f*, 42*g*, 42*h* (see FIG. 8A) of the bearing sleeve. According to the present invention, sets of corresponding bores 42*a*, 42*b*, 42*c*, 42*d*, 42*e*, 42*f*, 42*g*, 42*h* (see FIG. 8A) and openings 52*a*, 52*b*, 52*c*, 52*d*, 52*e*, 52*f* are configured to align every 15° when the adjusting nut 50 is rotated in relation to the bearing sleeve 40 in either rotational direction in order to receive the fasteners 60 (see FIGS. 5B, 7 and 9) to couple the adjusting nut 50 to the bearing sleeve 40 when the adjustment of the impeller clearance is completed. In effect, the bores 42*a*, 42*b*, 42*c*, 42*d*, 42*e*, 42*f*, 42*g*, 42*h* may be configured or formed in the bearing sleeve 40, and the openings 52*a*, 52*b*, 52*c*, 52*d*, 52*e*, 52*f* may be configured or formed to pass completely through the adjusting nut 52, so that each fastener 60 passes completely through the adjusting nut 50 and fastener threads engage a respective thread of a respective bore 42*a*, 42*b*, 42*c*, 42*d*, 42*e*, 42*f*, 42*g*, 42*h*.

Consistent with that shown in FIGS. 8A and 8B, the bores 42*a*, 42*b*, 42*c*, 42*d*, 42*e*, 42*f*, 42*g*, 42*h* (FIG. 8A) may include eight (8) bores, and the openings 52*a*, 52*b*, 52*c*, 52*d*, 52*e*, 52*f* (FIG. 8B) may include six (6) openings. The bores 42*a*, 42*b*, 42*c*, 42*d*, 42*e*, 42*f*, 42*g*, 42*h* may be equally spaced about the bearing sleeve surface 42 about 45° apart; and the openings 52*a*, 52*b*, 52*c*, 52*d*, 52*e*, 52*f* may be equally spaced about 60° apart about the adjusting nut surface 42. Consistent with that shown in FIG. 8C, when the adjustment of the impeller clearance is completed, one set of the corresponding bores and openings (e.g., like bore 42*a* and openings 52*a*) and may be diametrically opposed from another set of the corresponding bores and openings (e.g., like bore 42*e* and opening 52*d*) on opposite sides of the bearing sleeve surface 42 and adjusting nut surface 52 in order to receive the fasteners 60 (see FIGS. 5B, 7 and 9) to couple the adjusting nut 50 to the bearing sleeve 40. In effect, consistent with that described in relation to FIG. 7, the combination of hole pattern having eight 45° spaced-apart bores 42*a*, 42*b*, 42*c*, 42*d*, 42*e*, 42*f*, 42*g*, 42*h* (FIG. 8A) and six 60° spaced-apart openings 52*a*, 52*b*, 52*c*, 52*d*, 52*e*, 52*f* allows two (2) holes (i.e., two bore/opening combinations) to line up every 15° and achieve an impeller clearance to within 0.0012" (based upon using a standard thread) of the best hydraulic performance setting. FIG. 8C shows an overlay of the bearing sleeve 40 and the adjusting nut 50, e.g., with the bores 42*a*, 42*b*, 42*c*, 42*d*, 42*e*, 42*f*, 42*g*, 42*h* (FIG. 8A) shown in phantom lines. FIG. 8C also shows diametrically opposed bores/openings 42*a*/52*a*, 42*e*/52*d* aligned in the present position shown, shows how a 15° clockwise rotation of the adjusting nut 50 will align diametrically opposed bores/openings 42*d*/52*c*, 42*h*/52*f*, and shows how a 15° counterclockwise rotation of the adjusting nut 50 will align diametrically opposed bores/openings 42*b*/52*b*, 42*f*/52*e*. As a person skilled in the art would also appreciate, FIG. 8C also shows how a 30° clockwise rotation of the adjusting nut 50 will align diametrically opposed bores/openings 42*c*/52*b*, 42*g*/52*e*, and shows how a 30° counterclockwise rotation of the adjusting nut 50 will align diametrically opposed bores/openings 42*c*/52*c*, 42*g*/52*f*.

Consistent with that shown in FIGS. 7 and 9, the bearing sleeve 40 may include a circumferential bearing sleeve surface 44 having bearing sleeve markings (e.g., like elements labeled 44*c*, 44*d*, 44*e*) corresponding to the bores 42*a*, 42*b*, 42*c*, 42*d*, 42*e*, 42*f*, 42*g*, 42*h*. According to the present invention, the bores 42*a*, 42*b*, 42*f*, 42*g*, 42*h*are understood to also have corresponding bearing sleeve markings that are not shown in the drawing. Similarly, the adjusting nut 50 may include a circumferential adjusting nut surface 54 having adjusting nut markings (e.g., like elements labeled 54*b*, 54*c*, 54*d*) corresponding to the openings 52*a*, 52*b*, 52*c*, 52*d*, 52*e*, 52*f*, so that after positioning the working side 22*a*' of the impeller 22*a* in relation to the casing member 22*b*, closest markings on the circumferential bearing sleeve surface 44 and the circumferential adjusting nut surface 54 are aligned to allow each fastener 60 to be installed in a respective set of the corresponding bores and openings like elements 42*a*, 52*a*and 42*e*, 52*d* shown in FIG. 8C. According to the present invention, the openings 52*a*, 52*e*, 52*f* are understood to also have corresponding adjusting nut markings that are not shown in the drawing. (The adjusting nut markings are also known herein as "hole/opening locator markings.") In effect, consistent with that described in FIG. 9, after positioning the impeller 22*a*, it is only necessary to align the closest markings on the bearing sleeve 40 and adjusting nut 50 to allow the fasteners 60 to be installed. As a person skilled in the art would also appreciate, FIG. 9 also shows that the next set of holes are 15° apart, and then 30°.

In addition to the six adjusting nut markings corresponding to the openings 52*a*, 52*b*, 52*c*, 52*d*, 52*e*, 52*f* of the adjusting nut 50, the circumferential adjusting nut surface 54 may also include additional markings between each pair of adjusting nut markings. By way of example, FIGS. 7 and 9-10 show three additional markings between each pair of adjusting nut markings, some of which are provided reference labels 54$b_3$, 54$c_3$, 54$d_1$, 54$d_2$. As shown, the three additional markings between each pair of adjusting nut markings are spaced equi-distantly so as to be at 15° intervals. In effect, the six adjusting nut markings and the three additional markings between each pair of adjusting nut markings combine to form 24 adjusting nut marks, spaced equi-distantly about the circumferential adjusting nut surface 54 at 15° intervals. In FIGS. 7 and 9-10, the adjusting nut markings corresponding to the openings 52*a*, 52*b*, 52*c*, 52*d*, 52*e*, 52*f* are shown as slightly longer markings in length extending in parallel along the shaft axis, while the three additional adjusting nut markings between each pair of adjusting nut markings are shown as slightly shorter markings in corresponding length. The difference in the length between the two sets of markings helps a user visually distinguish the different types of markings.

The three additional shorter markings between each pair of adjusting nut longer markings may be used to further simplify how a user would set the impeller running clearance without the need of any measuring devices.

By way of example, the steps to set the impeller running clearance may include the following:

1) Rotate the adjusting nut 50 until the adjusting nut surface disengages from the bearing sleeve surface 42, the impeller 22*a* is now in contact with the casing.
2) Rotate the adjusting nut 50 in the opposite direction until the adjusting nut surface comes in contact with the bearing sleeve surface 42.
3) Locate the "hole/opening locator marking" which is closest to a bearing sleeve marking. In FIG. 10A, see the location where the bearing sleeve marking 44*d* and "hole/opening locator marking" 54*d*, and compare to the corresponding location where bearing sleeve marking 44*c* and "hole/opening locator marking" 54*c*. The bearing sleeve marking that is closest to the hole/opening locator marking will now be the user's selected bearing sleeve index marking that is referenced as 44*d* in FIG. 10A. This can be considered a so-called "zero" point for this pumping device as it coincides with a zero gap between the impeller 22*a* and the casing, e.g., based upon step 2 above.
4) Count a predetermined amount of adjusting nut markings (determined by the amount of Impeller clearance required) on the adjusting nut 50, in the opposite direction of the intended adjusting nut rotational direction. For instance, if the desired impeller running clearance is 0.012 in, and each marking represents 0.0023 in, then the number of adjusting nut index markings that should be counted is 5 (e.g., since 0.012/0.0023=about 5). Then starting from the adjusting nut marking 54*d*, select an adjusting nut marking corresponding to the count of 5, which is referenced as the adjusting nut marking 54$b_3$, as shown in FIG. 10A. Rotate the adjusting not 50 so the selected adjusting nut marking 54$b_3$ on the adjusting nut surface 54 is aligned with the selected bearing sleeve index marking 44*d* on the bearing sleeve 40 as shown in FIG. 10B.
5) As shown in FIG. 10B, there will now also be two holes/openings in the adjusting nut 50 aligned with two bores in the bearing sleeve 40. They can be located by looking for the "hole/opening locator marking" on the adjusting nut 50 which is in alignment with a bearing sleeve marking. In FIG. 10B, by way of one example, see where the "hole/opening locator marking" 54*b* on the adjusting nut surface 54 and the bearing sleeve marking 44*c* on the circumferential bearing sleeve surface 44 are aligned. (By way of example, this may or may not be the originally selected index marking on the bearing sleeve 40.) Place the fasteners 60 at these two locations fasten the adjusting nut 50 to the bearing sleeve 40 to set the impeller running clearance.

FIG. 11

FIG. 11 shows an alternative 10-8 hole-bore combination, where the adjusting nut may be configured with 10 holes, and the bearing sleeve may be configured with 8 bores, e.g., achieving about a 9° adjustment interval when using a shaft surface having 20 TPI, result in about 0.00125" of shaft travel, and allowing an impeller setting accuracy of about 0.00063".

FIG. 11 shows the 10 holes or openings of the adjusting nut like element 50 (e.g. see FIGS. 8 and 8B) as reference labels 152*a*, 152*b*, 152*c*, 152*d*, 152*e*, 152*f*, 152*g*, 152*h*, 152*i*, 152*j*, e.g., arranged uniformly around the centerline of the pump shaft at about 36° angles.

FIG. 11 shows the 8 bores of the bearing sleeve like element 40 (e.g. see FIGS. 8 and 8A) as reference labels 142*a*, 142*b*, 142*c*, 142*d*, 142*e*, 142*f*, 142*g*, 142*h*, e.g., arranged uniformly around the centerline the pump shaft at about 45° angles.

In FIG. 11, the symbol $\alpha$=9°, which is the adjustment interval, e.g., when the adjusting nut is rotated in relation to the bearing sleeve in either direction in order to receive fasteners to couple the adjusting nut to the bearing sleeve when the adjustment of the impeller clearance is completed.

THE SCOPE OF THE INVENTION

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the invention has been described and illustrated with respect to exemplary embodiments thereof, the foregoing and various other additions and omissions may be made therein and thereto without departing from the spirit and scope of the present invention.

We claim:

1. A pump comprising:

a bearing sleeve configured to couple to a pump shaft, and also configured with a bearing sleeve surface having bores for receiving fasteners; and an adjusting nut configured with a central bore having central bore threads to rotationally couple to pump shaft threads of the pump shaft, configured to rotate in relation to the bearing sleeve and move the pump shaft axially to adjust an impeller clearance between a working side of an impeller arranged on the pump shaft and a casing of the pump, and configured with an adjusting nut surface having openings that are different in number than the bores, sets of corresponding bores and openings configured to align at angular adjustment intervals about every 9° or 15° when the adjusting nut is rotated in relation to the bearing sleeve in either direction in order to receive fasteners to couple the adjusting nut to the bearing sleeve when the adjustment of the impeller clearance is completed.

2. A pump according to claim 1, wherein the bores include eight (8) bores, and the openings include six (6) openings.

3. A pump according to claim 1, wherein the bores are equally spaced about the bearing sleeve surface about 45° apart, and the openings are equally spaced about 60° apart about the adjusting nut surface.

4. A pump according to claim 1, wherein one set of the corresponding bores and openings is diametrically opposed from another set of the corresponding bores and openings on opposite sides of the bearing sleeve surface and adjusting nut surface.

5. A pump according to claim 1, wherein the bearing sleeve comprises a circumferential bearing sleeve surface having bearing sleeve markings corresponding to the bores; and the adjusting nut comprises a circumferential adjusting nut surface having adjusting nut markings corresponding to the openings, so that after positioning the working side of the impeller in relation to the casing, closest markings on the circumferential bearing sleeve surface and the circumferential adjusting nut surface are aligned to allow each fastener to be installed in a respective set of the corresponding bores and openings.

6. A pump according to claim 5, wherein the circumferential adjusting nut surface includes one or more additional adjusting nut markings between each pair of adjusting nut markings corresponding to the openings.

7. A pump according to claim 6, wherein the one or more additional adjusting nut markings includes three additional adjusting nut markings between each pair of adjusting nut markings corresponding to the openings spaced equi-distantly so as to be at about 15° intervals.

8. A pump according to claim 7, wherein the one or more additional adjusting nut marking are slightly shorter in length than the adjusting nut marks corresponding to the openings.

9. A pump according to claim 1, wherein the pump comprises a bearing assembly having some combination of a bearing housing, bearings arranged therein, the bearing sleeve and the adjusting nut.

10. A pump according to claim 1, wherein the pump comprises the casing and the pump shaft having the impeller hard mounted on one end.

11. A pump according to claim 1, wherein the bores are configured or formed in the bearing sleeve, and the openings are configured or formed to pass completely through the adjusting nut, so that each fastener passes completely through the adjusting nut and fastener threads engage a respective thread of a respective bore.

12. A pump according to claim 1, wherein the threads on the pump shaft surface are configured using a Unified Thread Standard (UTS), and the impeller clearance is within about 0.0012 inches based upon the same.

13. A pump according to claim 1, wherein the bearing sleeve is couples to the pump shaft using a key-based coupling arrangement.

14. A bearing assembly comprising:

a bearing sleeve configured to couple to a pump shaft, and also configured with a bearing sleeve surface having bores for receiving fasteners, the bores being arranged uniformly about the pump shaft at a first predetermined angle; and an adjusting nut configured with a central bore having central bore threads to rotationally couple to pump shaft threads of the pump shaft, configured to rotate in relation to the bearing sleeve and move the pump shaft axially to adjust an impeller clearance between a working side of an impeller arranged on the pump shaft and a casing of rotating equipment, and configured with an adjusting nut surface having openings that are different in number than the bores, the openings being arranged uniformly about the pump shaft at a second predetermined angle that is different from the first predetermined angle;

sets of corresponding bores and openings configured to align at predetermined angular intervals defined by a differential relationship between the first predetermined angle and the second predetermined angle, e.g., including at the predetermined angular intervals of about every 9° or 15°, when the adjusting nut is rotated in relation to the bearing sleeve in either direction in order to receive fasteners to couple the adjusting nut to the bearing sleeve when the adjustment of the impeller clearance is completed.

15. A bearing assembly according to claim 14, wherein either the bores include eight (8) bores uniformly arranged about the pump shaft at about 45°, and the openings include six (6) openings uniformly arranged about the pump shaft at about 60°, or the bores include six (6) bores uniformly arranged about the pump shaft at about 60°, and the openings include eight (8) openings uniformly arranged about the pump shaft at about 45°; and the predetermined angular intervals are about 15°.

16. A bearing assembly according to claim 14, wherein either the bores include eight (8) bores uniformly arranged about the pump shaft at about 45°, and the openings include ten (10) openings uniformly arranged about the pump shaft at about 36°, or the bores include ten (10) bores uniformly arranged about the pump shaft at about 36°, and the openings include eight (8) openings uniformly arranged about the pump shaft at about 45°; and the predetermined angular intervals are about 9°.

17. A bearing assembly according to claim 14, wherein the pump shaft comprises a pump shaft surface having a predetermined number of threads per inch (TPI) that determines the travel of the adjusting nut when the adjusting nut is rotated in relation to the bearing sleeve in either direction in order to receive fasteners to couple the adjusting nut to the bearing sleeve during the adjustment of the impeller clearance; and the predetermined angular intervals are configured to determine the increments for setting the impeller clearance when the adjustment of the impeller clearance is completed.

18. A bearing assembly according to claim 14, wherein the bearing sleeve comprises a circumferential bearing sleeve surface having bearing sleeve markings corresponding to the bores; and the adjusting nut comprises a circumferential adjusting nut surface having adjusting nut markings corresponding to the openings, so that after positioning the working side of the impeller in relation to the casing, closest markings on the circumferential bearing sleeve surface and the circumferential adjusting nut surface are aligned to allow each fastener to be installed in a respective set of the corresponding bores and openings.

19. An impeller/casing adjustment combination for adjusting an impeller in relation to a casing of a pump, comprising:

a pump shaft having a pump shaft surface with pump shaft threads configured on one end, and having an impeller configured on another end;

a bearing sleeve configured to couple to the pump shaft, and also configured with a bearing sleeve surface having bores for receiving fasteners, the bores being arranged uniformly about the pump shaft at a first predetermined angle; and an adjusting nut configured with a central bore having central bore threads to rotationally couple to the pump shaft threads of the pump shaft, configured to rotate in relation to the bearing sleeve and move the pump shaft axially to adjust an impeller clearance between a working side of the impeller and a casing of a pump, and configured with an adjusting nut surface having openings that are different in number than the bores, the openings being arranged uniformly about the pump shaft at a second predetermined angle that is different from the first predetermined angle;

sets of corresponding bores and openings configured to align at predetermined angular intervals defined by a differential relationship between the first predetermined angle and the second predetermined angle, e.g., including at the predetermined angular intervals of about every 9° or 15°, when the adjusting nut is rotated in relation to the bearing sleeve in either direction in order to receive fasteners to couple the adjusting nut to the bearing sleeve when the adjustment of the impeller clearance is completed.

20. An impeller/casing adjustment combination according to claim 19, wherein the bores include eight (8) bores uniformly arranged about the pump shaft at about 45°, and the openings include six (6) openings uniformly arranged about the pump shaft at about 60°, or the bores include six (6) bores uniformly arranged about the pump shaft at about 60°, , and the openings include eight (8) openings uniformly arranged about the pump shaft at about 45° ; and the predetermined angular intervals are about 15°.

21. An impeller/casing adjustment combination according to claim 19, wherein either the bores include eight (8) bores uniformly arranged about the pump shaft at about 45°, and the openings include ten (10) openings uniformly arranged about the pump shaft at about 36°, or the bores include ten (10) bores uniformly arranged about the pump shaft at about 36°, and the openings include eight (8) openings uniformly arranged about the pump shaft at about 45°; and the predetermined angular intervals are about 9°.

22. An impeller/casing adjustment combination according to claim 19, wherein the pump shaft comprises a pump shaft surface having a predetermined number of threads per inch (TPI) that determines the travel of the adjusting nut when the adjusting nut is rotated in relation to the bearing sleeve in either direction in order to receive fasteners to couple the adjusting nut to the bearing sleeve during the adjustment of the impeller clearance; and the predetermined angular intervals are configured to determine the increments for setting the impeller clearance when the adjustment of the impeller clearance is completed.

23. An impeller/casing adjustment combination according to claim 19, wherein the bearing sleeve comprises a circumferential bearing sleeve surface having bearing sleeve markings corresponding to the bores; and the adjusting nut comprises a circumferential adjusting nut surface having adjusting nut markings corresponding to the openings, so that after positioning the working side of the impeller in relation to the casing, closest markings on the circumferential bearing sleeve surface and the circumferential adjusting nut surface are aligned to allow each fastener to be installed in a respective set of the corresponding bores and openings.

24. A pump comprising:

a bearing sleeve configured to couple to a pump shaft, and also configured with a bearing sleeve surface having bores for receiving fasteners, the bores being arranged uniformly about the pump shaft at a first predetermined angle; and an adjusting nut configured with a central bore having central bore threads to rotationally couple to pump shaft threads of the pump shaft, configured to rotate in relation to the bearing sleeve and move the pump shaft axially to adjust an impeller clearance between a working side of an impeller arranged on the pump shaft and a casing of rotating equipment, and configured with an adjusting nut surface having openings that are different in number than the bores, the openings being arranged uniformly about the pump shaft at a second predetermined angle that is different from the first predetermined angle;

sets of corresponding bores and openings configured to align at predetermined angular intervals defined by a differential relationship between the first predetermined angle and the second predetermined angle when the adjusting nut is rotated in relation to the bearing sleeve in either direction in order to receive fasteners to couple the adjusting nut to the bearing sleeve when the adjustment of the impeller clearance is completed.

25. A pump according to claim 24, wherein either the bores include eight (8) bores uniformly arranged about the pump shaft at about 45°, and the openings include six (6) openings uniformly arranged about the pump shaft at about 60°, or the bores include six (6) bores uniformly arranged about the pump shaft at about 60°, and the openings include eight (8) openings uniformly arranged about the pump shaft at about 45° ; and the predetermined angular intervals are about 15°.

26. A pump according to claim 25, wherein either the bores include eight (8) bores uniformly arranged about the pump shaft at about 45°, and the openings include ten (10) openings uniformly arranged about the pump shaft at about 36°, or the bores include ten (10) bores uniformly arranged about the pump shaft at about 36°, and the openings include eight (8) openings uniformly arranged about the pump shaft at about 45°; and the predetermined angular intervals are about 9°.

27. A pump according to claim 25, wherein the pump shaft comprises a pump shaft surface having a predetermined number of threads per inch (TPI) that determines the travel of the adjusting nut when the adjusting nut is rotated in relation to the bearing sleeve in either direction in order to receive fasteners to couple the adjusting nut to the bearing sleeve during the adjustment of the impeller clearance; and the predetermined angular intervals are configured to determine the increments for setting the impeller clearance when the adjustment of the impeller clearance is completed.

28. A pump according to claim 25, wherein the bearing sleeve comprises a circumferential bearing sleeve surface having bearing sleeve markings corresponding to the bores; and the adjusting nut comprises a circumferential adjusting nut surface having adjusting nut markings corresponding to the openings, so that after positioning the working side of the impeller in relation to the casing, closest markings on the circumferential bearing sleeve surface and the circumferential adjusting nut surface are aligned to allow each fastener to be installed in a respective set of the corresponding bores and openings.

* * * * *